United States Patent [19]

Willhide et al.

[11] 4,270,755

[45] Jun. 2, 1981

[54] STRATEGY BASED ELECTRONIC COMBAT GAME

[75] Inventors: Joseph W. Willhide, 17 Crown Ridge Rd., Wellesley, Mass. 02181; Henry L. Viarengo, Woburn, Mass.

[73] Assignee: Joseph Willhide, Wellesley, Mass.

[21] Appl. No.: 8,284

[22] Filed: Feb. 1, 1979

[51] Int. Cl.[3] ..... A63F 9/02

[52] U.S. Cl. ..... 273/313

[58] Field of Search ..... 273/1 E, 85 G, 101.2, 273/86 R, 86 B, DIG. 28, 310–313; 364/410

[56] References Cited

U.S. PATENT DOCUMENTS

| | | | |
|---|---|---|---|
| 3,874,669 | 4/1975 | Ariano et al. | 273/85 G |
| 4,017,072 | 4/1977 | Kurtz | 273/237 X |
| 4,053,740 | 10/1977 | Rosenthal | 273/313 |
| 4,059,272 | 11/1977 | Pullman | 273/237 |
| 4,093,223 | 6/1978 | Wilke et al. | 273/85 G |
| 4,095,791 | 6/1978 | Smith et al. | 273/DIG. 28 |
| 4,126,851 | 11/1978 | Okor | 273/313 |
| 4,162,792 | 7/1979 | Chang et al. | 273/85 G |
| 4,171,135 | 10/1979 | Doyle et al. | 273/237 |

OTHER PUBLICATIONS

*101 Basic Computer Games;* Digital Equipment Corp.; Mar., 1975; pp. 201–204.

Kasser, Joe; "Star Trek"; Jan. 9, 1976; pp. 1–7.

*Byte*; Oct., 1977; pp. 86–111.

*Analog Science Fiction/Science Fact;* "Spacewar"; Jul., 1971; pp. 67–79.

*Primary Examiner*—Vance Y. Hum

*Attorney, Agent, or Firm*—Wolf, Greenfield & Sacks

[57] ABSTRACT

An electronic strategy and battle game for one to four players including a visual display and audio sound effects. The game has three levels of complexity, namely basic, intermediate and advanced, and also has a self-teaching mode. In each level of play the object to win is to be the only player with remaining energy units. This is achieved by chasing and evading opponents through space and engaging in energy-depleting battles. In the basic level of play each player begins with ten units of energy and the entire game takes place in a combat mode. In the intermediate level of play each player starts with twenty energy units with play taking place on two different scales, one for combat and another for non-combat. In the advanced level of play each player begins with forty units of energy and additional features are added such as sensing scans in the non-combat mode. The advanced level of play also permits invisibility of a player's starship. The display in the preferred embodiment includes a four-by-four matrix with two additional status indicators and a two digit numeric display. The primary control is provided by a microcomputer receiving commands via a keyboard.

23 Claims, 8 Drawing Figures

STRATEGY BASED ELECTRONIC COMBAT GAME

BACKGROUND AND SUMMARY OF THE INVENTION

The present invention relates in general to an electronic game of the non-video type, and pertains, more particularly, to an electronic strategy game involving exploration, pursuit and battle in interplanatary space. The electronic game of this invention employs a microcomputer.

The game of this invention is a privileged information game that may be played by two to four players and also includes a special self-play mode for one player to enable this player to challenge the game's computer. There are three levels of play, namely basic, intermediate, and advanced, thus, providing a game that can be played by people of many different ages ranging from a game with little or no strategy to a fairly sophisticated stragetic game. The players interact with the game and each other through an LED display, a keyboard, and sound effects generated by the unit. In the privileged information aspect of the game this means that each player will have his own secret display which is only displayed during his turn. Among the features of this game is that each player is automatically cued when it is his turn and is also automatically dropped out of the game when his energy has been expended. The keyboard locks out all but the acceptable inputs at each stage of play. There are preferably ten different sound effects that are used in association with a dynamic LED display read-out.

In playing the game, each player is the commander of a starship who has been assigned to secure a new galaxy for a base of operations. Each starship starts out with the same number of energy units (fuel). The players then engage in various energy consuming maneuvers, battles and intelligence (information gathering) operations in an effort to "neutralize" their opponents. A player is neutralized when his or her energy supply has been depleted. The winning player will be the only remaining player whose starship has energy.

Each player interacts with the game through a command console which includes a keyboard and a computer display read-out. The read-out in the disclosed embodiment has a display screen comprised of a four-by-four LED array, a numeric energy read-out and several status indicators. During game play, the hand-held command console is passed from player to player. Prior to passing the unit to the next player, the current player turns the display area off so that no privileged information is passed to the next opponent.

The basic, intermediate and advanced levels of play allow the game to accommodate a wide range of player capabilities while providing an interesting and challenging game with respect to the players' capabilities. The levels are upward compatible. Each advance in level simply adds more player options while maintaining all the play features of the lower level. Hence, what was learned at one level can be applied when moving up to another level and learning to play the more advanced versions can take place in a progressive, fun-filled, step-by-step fashion. The game length is keyed to the level through the initial setting of the energies. Thus, for the basic level, which is aimed at the younger player, the play is relatively quick while for the advanced level the play is somewhat longer to allow for more serious strategic play.

The heart of the game of this invention is a microcomputer which may be the Texas Instruments TMS 1100 microcomputer. The keyboard that is used is electronically organized in a matrix configuration and is scanned by the microcomputer to detect a key depression. In the preferred embodiment the display is a four-by-four LED array with at least two additional status indicators and a two-digit, seven-segment LED numeric display which registers the energy remaining for the particular player.

BRIEF DESCRIPTION OF THE DRAWINGS

EXPOSITION In the drawings FIG. 1 shows the command console which includes a keyboard section with each of the keys or buttons 10 properly identified. The console also includes a display read-out section including a four-by-four array 12 which comprises a total of 16 LED indicators, status indicators 14, identified as an ALERT indicator and a COMBAT DISPLAY indicator. There is further provided in the read-out section a numeric display 16 which is a two-digit seven-segment display showing the energy remaining for each player during the player's turn. After a description of the different levels of play reference will then be made to a detailed construction of a system in accordance with the invention.

The game may be considered as having three modes:

(1) mutiplayer mode: for two to four players (2) self-play mode: a single player vs. the computer (3) teaching mode: a dynamic way to learn the game as well as the three levels of:

(1) basic (2) intermediate (3) advanced

Figure 1:
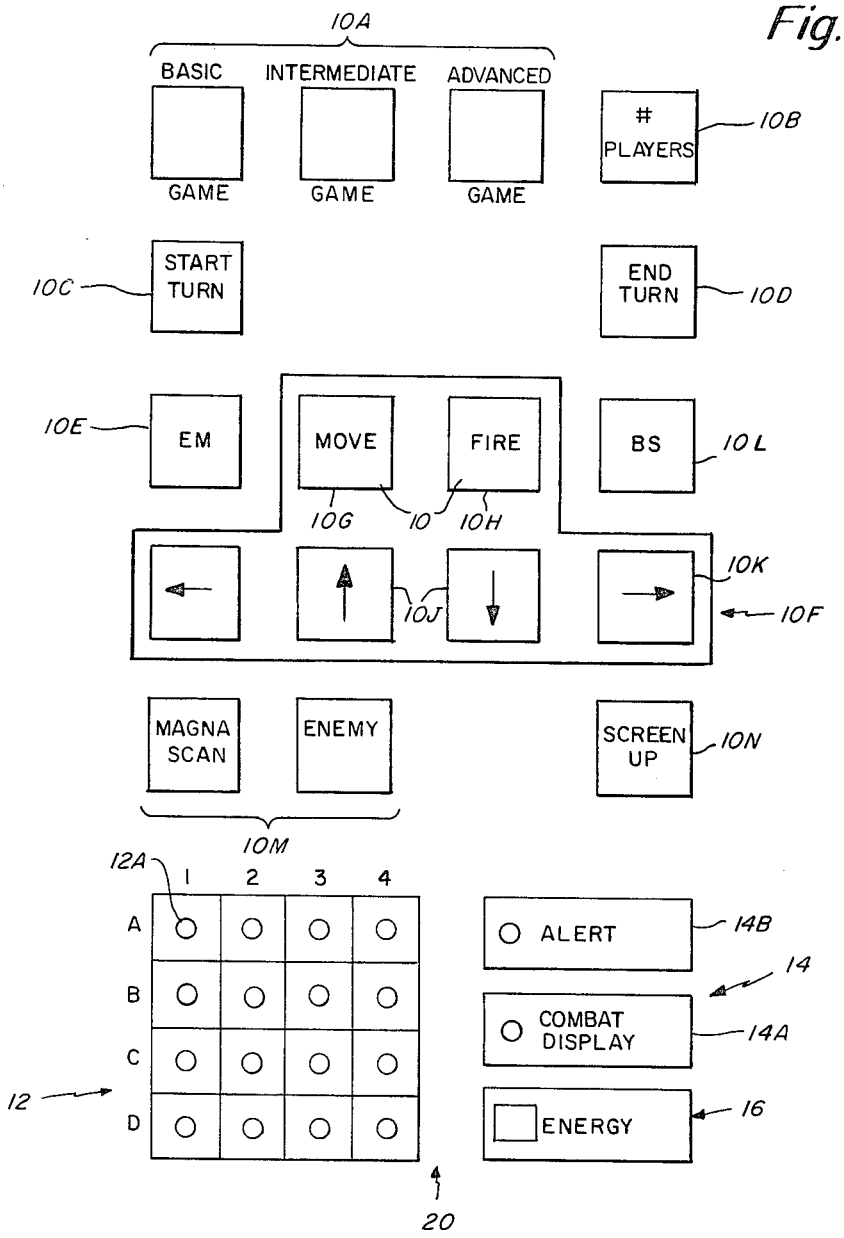
FIG. 1 is a schematic diagram of the command console including a keyboard section and a display section.

Hence, the first action taken in starting a new game is to indicate the desired mode (row 10A in FIG. 1), the number of players when appropriate (key 10B in FIG. 1) and a level of the game (row 10A in FIG. 1). This basic game setup takes place in a natural, easy way to remember. A new game is to be started only when the unit is alternately flashing a small and large square on the display screen. This will be the case when the unit is first turned on or at the end of the game. If, for some reason it is desired to start a new game when the victory display (flashing small and large squares) is not on the display screen, then one simply turns the power off for a short period of time subsequently turning it back on.

The part of the keyboard used during initial setup of the game is concerned with row 10A of FIG. 1. The keyboard is preferably color-coded to aid in associating the various keys with the game levels. The game keys for the basic, intermediate and advanced levels are colored yellow, red and green, respectively. The keys uniquely associated with each level are all coded with the same color as the start key for that level. Of course, games at the higher levels can use all the keys of the lower levels but not conversly. The keys in row 10A plus the keys 10C and 10D which are not associated with any particular level but are used in the game initial setup and starting and terminating a turn, are coded white to indicate their universality and independence from the game levels. The game setup for the self-play mode is given hereinafter along with the initial setup for the teaching mode. For now the discussion is limited to the multiplayer mode.

Thus, to start the multiplayer game and assuming that the victory display is flashing on the display screen, the level is first selected, by appropriate selection of one of the keys in row 10A, basic, intermediate or advanced play. At that time on the numeric display 16 a "PO" with the O flashing appears. Next, key 10B is repeatedly depressed to indicate the number of players that will be playing. The number of players will appear on the display 16. To then start play for the first player the "START TURN" button 10C is then selected by the first player.

Because of the priviledged information design of the electronic game of this invention, each player in a multiplayer game activates and reactivates (buttons 10C and 10D) the command console during his or her turn. Both of the keys 10C and 10D are color-coded white.

During game play, each player assumes a number from one up to four which corresponds to the order in which they take their turn following the starting of a new game. Thus, the first player to take a turn after starting a new game is player number one and so forth. To activate the command console, a player hits the "START TURN" key when his number is flashing on the energy/player display 16. Players who are out of the game because they have no energy left will be automatically skipped. That is, their player number will not be displayed, indicating to them that they are in fact out of the game. All of this occurs under computer software control as discussed in more detail hereinafter.

After the player commences operation by hitting the button 10C, following display of his number, the computer display read-out 12 is activated so as to display that particular player's priviledged information. The player then proceeds with his turn and is cued that his turn has ended by a flashing of the energy read-out 16. At that time, the player then operates the "END TURN" button or key 10D to blank the display area and then passes the unit to the next active player. If he does not terminate his operation within say ten seconds after the end of turn indication, then an end-of-turn sound effect is generated to remind the player and at the same time also informing the other players of a termination of the player's turn.

BASIC LEVEL OPERATION

Figure 5:
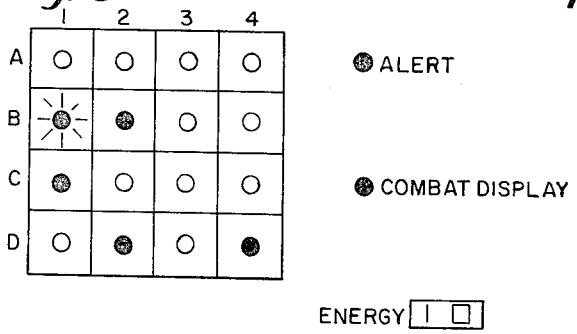
FIG. 5 shows one format on the display for the basic level of play.

Immediately after activating the console on his/her first turn, the player is presented with an animated visual effect accompanied by a battle stations siren. This serves to set the tone for the game, that is, one of battle which, as we shall see, is the essence of the basic level game. The player then strikes the BATTLE STATION key 10L and then the command read-out might look as depicted in FIG. 5. The ALERT indicator and also the COMBAT DISPLAY indicator are on to indicate to the player that this is a combat situation. The energy read-out 16 contains ten units of energy, which is the starting energy for the basic game. The player's starship is identified in FIG. 5 blinking on the display screen. In this particular setup the starship is at location B1 on the four-by-four array. Enemy starships and planets also show on the display screen in the combat mode. Both the enemy starship and planets are shown as steady LED illuminations and therein lies the challenge to the player, that is, to distinguish between a planet and a enemy starship as soon as possible so that an effective hit can be scored on an enemy ship. In FIG. 5 the locations of either the enemy starship or the planet are at B2, C1, D2 and D4. Anywhere from one to four planets usually occur in the array during combat. The number of planets and their placement is totally random and will vary from game to game. The planets do not move and their positions remain fixed for the duration of each game. However, the enemy ship, of course, moves.

The section of the keyboard used in the basic game includes the row 10F and also the keys or buttons 10G and 10H. Thus, a player only has two choices during his/her turn, that is to move or fire. Each of these constitute a turn and a fire costs one unit of energy.

During combat, a player may move his or her ship about within the display sector comprised of the basic four-by-four matrix. These moves are accomplished with the use of the move key 10G on the command keyboard, when they move anywhere within the sector and even occupy the same position as a planet. However, a ship is still vulnerable to the opponent's weapons system when inhabiting a cell with a planet. One way of explaining a starship and planet occupying the same cell is that the starship has landed on the planet. A player cannot, however, occupy the same position as an opponent's. An attempted move into a cell occupied by another starship will result in the player's ship being randomly relocated to a new and different cell within the sector. All maneuvering is accomplished through moves to adjacent cells in a horizontal or vertical direction. One move constitutes a turn but uses no energy. A move is made by first depressing the 'MOVE' key 10G followed by a direction key, such as key 10K for direction '→'. If a move is attempted outside the sector, e.g., to the right when on the righthand edge, the direction key will not be accepted.

In combat, a player tries to score a bit on an opponent's ship by firing his ship's weapons system. Firing paths are away from the player's position in a horizontal or vertical direction only. A fire path cannot pass through a cell occupied by a planet but may extend all the way to the edge of the sector unless blocked by a planet or an opponent's ship. Successfully hitting an opponent's ship is indicated by a "blast" flash in the display screen and accompanying sound effect of an explosion. A ship that has been hit is disrupted to a random location within the sector. The ship also suffers an energy loss of three units. An unsuccessful firing is indicated by the sound effect of the weapons system firing with no other response. A firing operation constitutes a turn and uses one unit of energy. It is inhibited by first depressing 'FIRE' key 10H followed by a direction key, e.g., '→' (key 10K). A player can suffer a hit when occupying the same cell as a planet even though the fire path is stopped by the cell. A player can also fire when inhibiting the same cell as a planet.

Neutralization of a player's ship occurs when the ship's energy supply has been depleted (zero energy units) as a result of combat or play. A player whose ship is neutralized is dropped from the game. The end of the game is arrived at when only one player has remaining energy supplies. When this occurs a special visual effect, the victory display, appears on the display screen of the winning player and the unit will accept the key strokes required to start a new game.

INTERMEDIATE LEVEL OPERATION

The intermediate level adds another level to the game, a non-combat mode, to augment the combat-only mode of the basic level. The intermediate game always starts in the non-combat mode. In this mode, the display screen presents a view of the entire galaxy which has been divided into sixteen sectors. The non-combat display mode is signaled by the absence of illumination of the 'COMBAT DISPLAY' indicator 14A. The only object which shows on the display screen in this mode is the player's own starship. A basic objective in the non-combat mode is to seek out Magna, a special energy giving star, to increase the ship's energy supply. As this takes place, players may move into sectors which are occupied by an opponent. This presents the opportunity to pursue combat. In addition to possible encounters with the enemy and excursions to Magna's sector, a player may move into a sector with a Black Hole and lose energy. Each player in the intermediate level game starts off with twenty units of energy.

Magna is the energy giving star. Every time a starship enters the sector occupied by Magna, the starship gains five units of energy. This is accompanied by a sound effect which represents a charging of the starship's energy banks. After giving a starship energy, Magna is randomized under computer control to some other sector in the galaxy. There is only one Magna and it does not show on the display.

When a starship warps into the same sector as the Black Hole, it loses three energy units for that turn. The loss of energy is accompanied by a sound representing the energy banks being drained. There is only one Black Hole, which is randomly placed at the beginning of each game, and it remains in a fixed position for the duration of the game.

To maneuver in the non-combat mode, a player hits the 'MOVE' key 10G followed by the desired direction key, e.g., '↑'. Moves cost one energy unit in the non-combat mode and terminate the turn.

When the direction key is entered, the display screen is updated to reflect the starship's new sector. Moves can only be made to adjoining sectors in a horizontal or vertical direction. A player cannot move out of the galaxy, e.g., a move up will not be accepted when the player is in sectors A1, A2, A3, or A4.

Play at the inermediate level uses all the keys of the Basic Level plus the following two keys which have been color-coded red. The 'BS' (BATTLE STATIONS) and 'EM' (EVASIVE MANEUVERS) keys 10L and 10E, respectively, are used for responding to potential conflict situations.

If an enemy ship is within one section (horizontal or vertical only) of the current player's ship, then a Near Alert condition will be shown by flashing the 'ALERT' indicator 14B and flashing the current player's ship on the display screen. If the current player moves into the same sector as another player, then a Red Alert exists ('ALERT' indicator 14B on steady) and the current player must either hit 'BS' (BATTLE STATIONS) key 10L to enter into combat or take EVASIVE MANEUVERS ('EM') (key 10E) at a cost of two energy units. In Red Alert the player's ship flashes on the display screen. On entry to a Red Alert condition, a siren sound is generated to build excitement, clue the other players on what is happening and prompt for a BATTLE STATIONS or EVASIVE MANEUVERS response from the active player.

Combat may occur when two or more players occupy the same sector and is signaled by a Red Alert. A player who decides to participate in a combat situation must call his ship to Battle Stations. Depressing the 'BS' key 10L changes his display screen to a combat display view of the sector he is in. It also allows the use of the weapons system and for maneuvering within the sector. A player may choose to avoid or end a combat situation by hitting the 'EM' button 10E. Use of evasive maneuvers costs two energy units. Once in combat, the game play is exactly as in the basic level game with the only exception being the use of evasive maneuvers to escape from a combat situation.

When a combat display view of a sector is being displayed on the display screen, the 'COMBAT DISPLAY' indicator 14A is on. One can think of the combat display as being a four times (4X) magnification of the sector in which combat is taking place. Hence, objects like the planets and the enemy ship, which do not show up in the non-combat display, do show up in the magnified combat display.

A starship's position within a section; that is, its position during combat display, is maintained as the starship moves from sector to sector in the non-combat mode. The only exception to this rule is the case where a starship would end up in the same cell as another ship. In this case, the location of the starship moving into the sector is randomized at the combat display level, i.e., within the sector.

ADVANCED LEVEL GAME

The advanced level game can be considered an extension of the intermediate level game making available more options in the play of the game. A new space phenomenon, the Space Wrinkle, is added to the non-combat mode along with the ability to do information gathering operations through the use of Sensor Scans (see FIG. 1 row 10M). The combat mode is enhanced through the addition of a "Screen Up" option (see FIG. 1 area 10N). All of the play features of the intermediate and basic level games are retained in the advanced game. The added keys for the advanced level are color-coded green. The starships start off with forty units of energy in the advanced game.

As in the intermediate game, Magna, the energy giving star, gives each starship entering its sector five units of energy. This is accompanied by a sound representing the charging of the starship's energy banks. There is only one Magna and it only moves after it gives energy. As was the case in the intermediate game, Magna is randomly placed at the beginning of the game.

When a starship moves into the same sector as a Space Wrinkle, it is randomized to a sector other than the one intended on the maneuver. A playful tone sequence signals that a starship is passing through a Space Wrinkle. There are two Space Wrinkles, which are randomly placed at the beginning of each game, and they remain in fixed positions for the duration of the game. This aspect of the game is essentially not controlled by the players via the keyboard.

Figure 6:
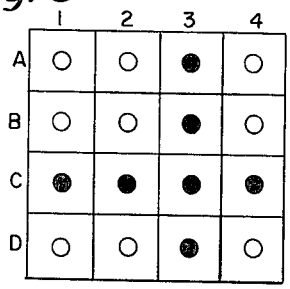
FIG. 6 shows a format on the display for an advanced level of play of the game.

Sensor scans introduce a value of information aspect into the game. For the cost of one energy unit, a player can do a sensor scan for Magna or to locate an enemy ship. The desired sensor scan is activated by depressing the key associated with that scan. The readout of the sensor scan is through the use of "dynamic crosshairs" on the display screen. After several seconds of animated motion the crosshairs stop in a position such that the object being scanned for is located at the intersection of the row and column crosshairs. The display will remain static in this readout position for approximately five seconds and then revert back to the original sector display. A sample MAGNA SCAN readout is illustrated in FIG. 6 where MAGNA's location is shown to be sector C3. The enemy and Magna sensor scans are functional only during the non-combat mode. The keys in row 10M control these two functions. Either one or both may be activated during a turn and their use does not terminate the turn. However, sensor scans must be the first action taken by a player during his or her turn. On an enemy scan in a multi-player game, an enemy ship causing a Near Alert will always be shown whenever a Near Alert condition exists. Otherwise, the enemy ship pointed to is always the player's whose turn is next.

The screen function (area 10N of FIG. 1) is used only during combat and is used to make the player's ship invisible on the other players' displays. It must be activated each turn by pressing the 'SCREEN UP' key at a cost of one energy unit. When a player has his screen up, he can only move and cannot fire. A player who has his screen up can be hit by another player and suffer the usual damage even though the ship was invisible on the display.

The various maneuvers, information reports, and other play actions result, for the most part, in the expenditure of energy. The following table summarizes the associated energy cost and gains of the different aspects of play.

| ENERGY CONSUMPTION | | ENERGY GAIN | |
|---|---|---|---|
| Move (non-combat) | 1 | Magna | 5 |
| Move (combat) | $\phi$ | | |
| Sensor Scan | | | |
| Magna | 1 | | |
| Enemy | 1 | | |
| Screen Up | 1 | | |
| Combat | | | |
| Battle Stations | $\phi$ | | |
| Evasive Maneuvers | 2 | | |
| Black Hole | 3 | | |
| Space Wrinkle | $\phi$ | | |
| Hit (by enemy) | 3 | | |

SELF PLAY

A single player takes on an alien robot ship in the self-play mode. The robot ship is managed by the unit's micro-computer and is capable of executing all of the maneuvering, firing and other operations that are available to a "human" player. Games against the robot ship can be played at the basic, intermediate and advanced levels. The following keystroke sequence illustrates the starting of a self-play game at the intermediate level. Initially, the intermediate button in row 10A is selected, followed by pressing button 10B once indicating a single player and in turn followed by selection of button 10C. This is consistent with the way a multiplayer game is set up, i.e., the number of players is simply set to one in this case.

During game play, the player starts and ends his turn through use of the 'START TURN' and 'END TURN' keys 10C and 10D, respectively, in the same manner as previously outlined for a multiplayer game. After the player hits the 'END TURN' key, the computer takes its turn. This is accompanied by a sequence of "robot-like" random tones to indicate that the computer is taking its turn. The player then starts his next turn through use of the 'START TURN' key and play continues. The play of the game is exactly the same as a multiplayer game. The winner is signaled by the victory display. It will either come on during the player's turn, signifying the player as the winner, or after the player ends his turn, signifying the robot ship as the winner.

The teach mode can be viewed as a special case of self-play. In this mode all of the randomizations are repeatable and predictable. Hence, game scenarios which demonstrate the sound effects, visual effects and play of the game can be developed and presented in the instruction book. Teaching scenarios can be developed for all three game levels—basic, intermediate and advanced. The teach mode can be entered whenever the victory display is on the screen by hitting the game level key (basic, intermediate or advanced) followed by the 'START TURN' key 10C. At the time the 'START TURN' key is hit, the ENERGY/PLAYER display will by displaying 'PO' with the zero flashing. Thus, the teach mode is set up as if it were a zero player game.

In accordance with the game of this invention, the game can be played either with or without charting. However, play of the advanced game is enhanced through the use of charting. Players start charting once they have some experience and see its utility and at that point the charting will become quite natural. A simple version of a chart is a schematic of the display screen in the typical four-by-four array.

With the exception of the basic game, the game play takes place in two distinct modes, namely the non-combat and the combat modes. These two modes reflect the scale at which space is viewed through the display screen and hence can also be thought of as levels of play. In the non-combat level, the sixteen sectors which comprise the whole galaxy are viewed on the display screen. In the combat level, one of the sectors is magnified to a further breakdown of a four-by-four matrix with the single sector occupying the whole display screen. Compared to the single level approach, this two-level approach provides a more interesting game because there can be different types of bodies, phenomena and playing strategies at each level. Furthermore, the resulting size of the game tends to start action sooner and assures more action during the game. Beside the game play advantages, the two-level approach allows for the fabrication of the cost effective display screen.

In accordance with another feature that may be incorporated into the game, in the intermediate and advanced levels, the player who is aggressive and moves in on another player may be rewarded by an extended-move turn which gives that player an edge in combat. In this case the red alert siren serves to prompt the player that another entry can be made. This entry can be either the function Battle Stations (key 10L) or Evasive Maneuvers (key 10E).

Figure 3:
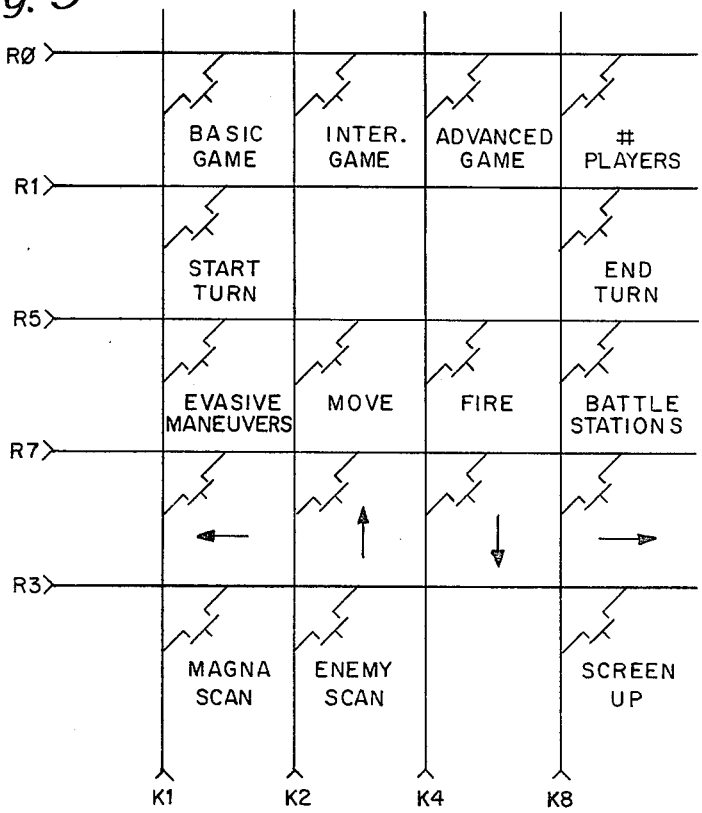
FIG. 3 is an electrical schematic of the keyboard of FIG. 2.
Figure 4:
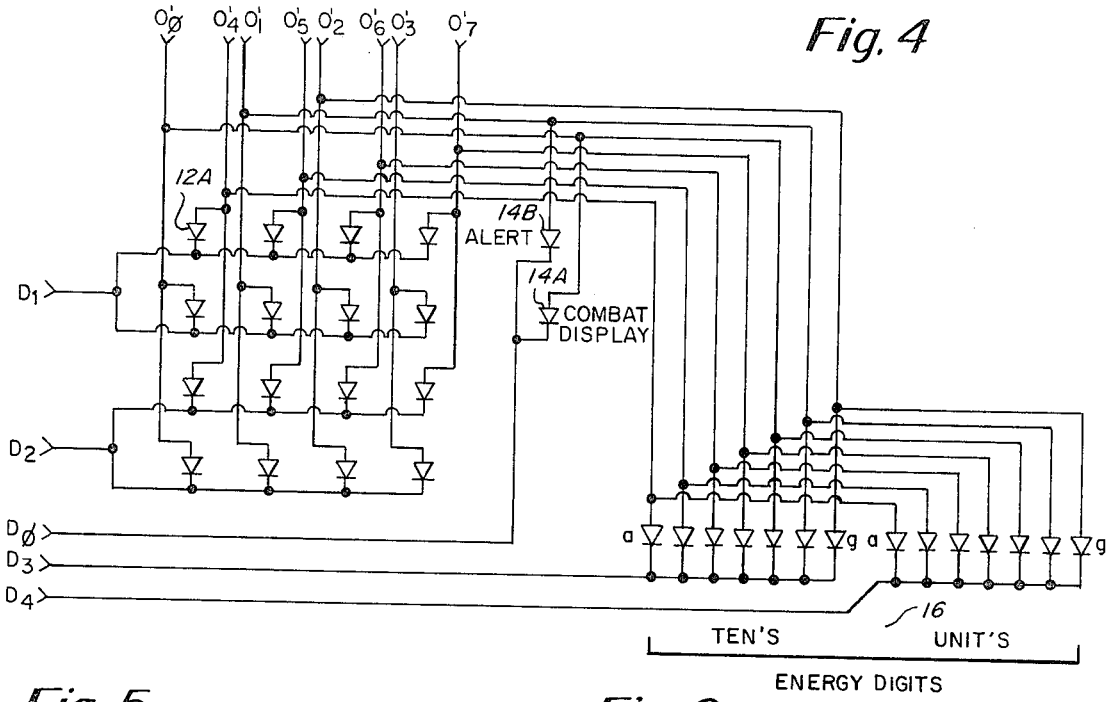
FIG. 4 is an electrical schematic of the display of FIG. 2.

The primary display readout in the game of this invention is the display screen 12 shown in FIGS. 1, 3, and 4. This is primarily a four-by-four array of sixteen cells with each cell position being illuminated by an LED indicator. FIG. 1 shows each of these indicators 12A. The display screen is used at both non-combat and combat levels of game play, reflecting, of course, a change in scale in viewing the galaxy. Each of the cells may be identified by the coordinates indicated in FIG. 1. At various points during game play the display screen may be animated to lend visual impact to the game, cue the player that a change is taking place, and thus heightening the sense of excitement in the game.

In FIG. 1 the combat display indicator 14A essentially illustrates the scale factor at which the display screen is operating and hence the level of play.

The readout 16 also shown in FIG. 1 gives the player's energy supply that is remaining and is updated to reflect the various actions taken by the player and hits sustained. It is also used to indicate the player whose turn is next during game play and when starting a new game to display the number of players that the game is being set up for.

The keyboard of this invention is illustrated in FIGS. 1 and 3. FIG. 1 shows the placement of each of the keys while FIG. 3 shows the electrical connection of the associated switches in a matrix coupling to certain terminals of the microcomputer 24. The keyboard is operated on a "guiding keyboard" concept which is built into the computer program. With this keyboard, only key depressions which are allowed and make sense are accepted at each stage of game play. Hence, wrong key depressions will not cause any problems. An added advantage to this approach is that the new player will actually learn much about the game play by actually playing. This follows from the well accepted teaching principle of positive reinforcement. Whenever a keystroke is accepted, a keyboard bleep sound is generated to give positive feedback to the player that the keystroke was accepted, to serve as a linkage between players to hold their interest when the console is not in their position, and also gives audio impact to the game.

The initial placements of the noncombat level space phenomena are computed at the start of the game based on random variables. From one game to the next these placements will vary in a non-deterministic fashion. The initial starting positions of the players are determined at the beginning of the game during game setup. Both the noncombat and combat scale positions are computed from random variables. Thus, initial starting positions for the players will vary from game to game. Player positions will be initialized to not coincide with any of the noncombat level space phenomena or combat level planet positions.

Anywhere from one to four planets can occur in a sector when in combat. The number of planets occupying each sector and their placement within each sector is determined at the start-up of the game. These attributes are computed using three independent random variables. Therefore, varying configurations are presented from one game to the next. A configuration, however, remains constant for the duration of each game.

Figure 2:
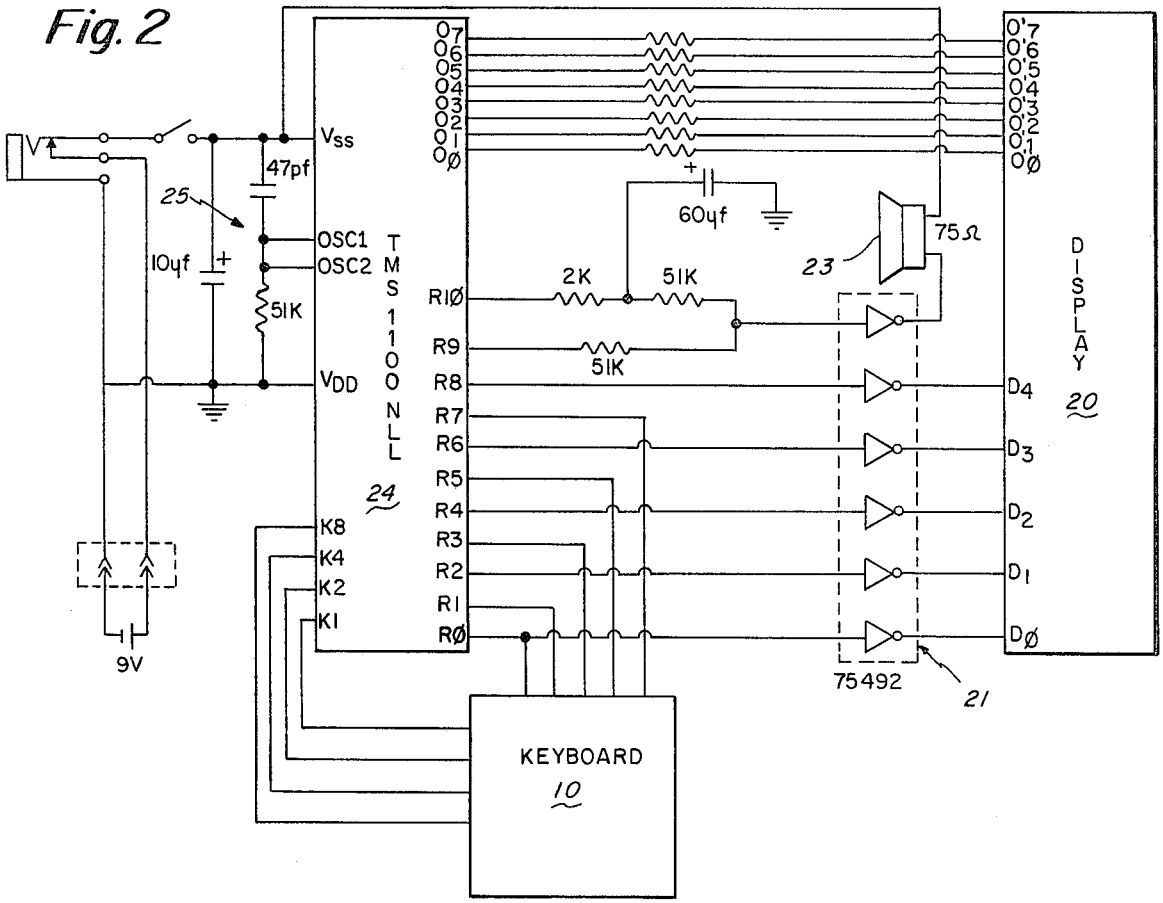
FIG. 2 is a schematic diagram of the electrical system of this invention including the micro computer, display and keyboard.

With regard to FIGS. 2–4 there is shown the display 20 keyboard 10, and the microcomputer 24. These components comprise the main pieces of the system. The microcomputer 24 is basically a conventional device having an internal read only memory, a random access memory, an arithmetic logic unit, preferably all on a single chip which functions according to the read only memory program and the system inputs. The arrangement of FIG. 2 shows the K and R lines coupling to the keyboard 10. In addition, some of the R lines also couple to the display along with the 0 lines. This arrangement permits a form of multiplexing allowing display at the same time that keyboard data can be accepted from the keyboard 10.

Figure 7:
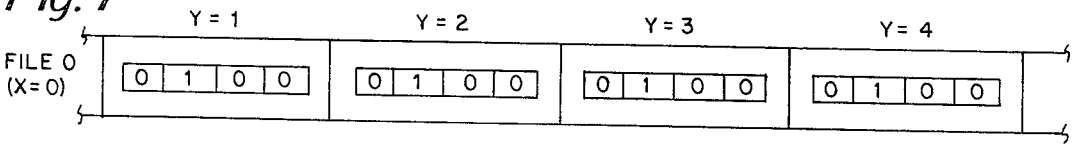
FIG. 7 shows the memory content for a particular operating sequence.

The display scanning technique of the present invention is now disclosed in more detail. It is assumed that the display is a four-by-four matrix with locations A3, B3, C3 and D3 being illuminated. The contents of the memory in the microprocessor for this situation is depicted in FIG. 7. In a conventional scanning approach, there are four drivers associated with a four-by-four array and the average current in the selected condition is relatively high. However, the approach used in accordance with the present invention is different than the conventional approach and is as illustrated in FIG. 4 with the same R line signal being tied in common with two spaced rows of indicators. As the array is scanned in a row-by-row fashion, the contents of even numbered RAM locations transferred as a four bit word to the $O_0$–$O_3$ output lines and the contents of odd numbered RAM locations are transferred as a four-bit word to the $O_4$–$O_7$ output lines. This is accomplished through the output programmable logic array of the microcomputer with mapping as defined in the following table.

$$O_0 = \overline{SL} \cdot A1$$
$$O_1 = \overline{SL} \cdot A2$$
$$O_2 = \overline{SL} \cdot A4$$
$$O_3 = \overline{SL} \cdot A8$$
$$O_4 = SL \cdot A1$$
$$O_5 = SL \cdot A2$$
$$O_6 = SL \cdot A4$$
$$O_7 = SL \cdot A8$$

Figure 8:
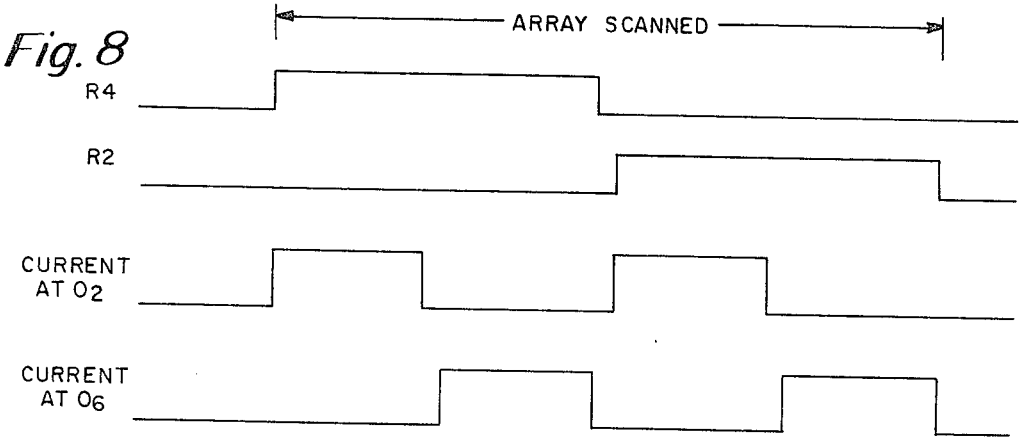
FIG. 8 shows a timing diagram associated with the system of this invention.

The status logic (SL) flip-flop in the TMS1100 microcomputer 24 is set to a "0" by the program whenever a display row from an even numbered memory location is transferred from memory to the accumulator and to a "1" for odd numbered memory locations. An R line is active for both transfers of the memory location corresponding to that number and the memory location corresponding to the R line number minus one. The timing diagram illustrates this approach in FIG. 8.

From the above we note that only two current sinking drivers are required as contrasted to four in the conventional case. Also, we see that the average current on any 0 line in this worst case situation is slightly less than 50% of the peak current on that line. This allows for better matching to the microcomputer's maximum ratings since it is specified with an average current of 50% of peak current on the 0 output lines.

In summary then, the technique used for driving the four by four LED array in the game allows for a better matching to the output characteristics of the TMS1100 microcomputer.

The following tables A and B show the ROM memory map as far as the program counter sequence is concerned in accordance with the concepts of this invention. The instructional manual with the microcomputer readily teaches one to program the microcomputer to operate in accordance with the invention. Many standard operations of the computer are employed to control the display in accordance with information inputted to the computer from the keyboard. The addressing scheme to the keyboard and to the display takes advantage of multiplexing between these units so as to operate in effective and efficient manner. Inputs from the keyboard, for example, are compared with stored information in the computer representative of fixed information such as the position of planets on the display or alterable information such as the position of enemy starships. The computer, of course, takes care of any coincidence between the player's starship, planets and the enemy starships and also controls where certain starships are relocated.

In FIG. 2 the resistors in the 0 lines coupling between the computer and the display are normal limiting resistors. The circuit 25 associated with the computer 24 is an oscillator circuit coupled to the clock input of the computer. There are also provided drivers 21 in some of the R lines between the computer and the display. FIG. 2 also shows the speaker 23 which is used for certain sound effects associated with the game. The speaker 23 is controlled basically from the R9 and R10 outputs of the computer 24.

TABLE A

CHAPTER $\phi$
ROM MEMORY MAP
(Program Counter Sequence)

| | | | | | | | | | | | | | | | |
|---|---|---|---|---|---|---|---|---|---|---|---|---|---|---|---|
| 0000=0F | 23 | 47 | 40 | 3E | 07 | 0C | 0C | 4D | 27 | 26 | 8A | 0D | 05 | 0C | 20 |
| 0010=03 | 27 | 9D | 38 | 27 | 7C | 98 | 18 | 4B | 9D | 07 | 0C | EA | 0F | 38 | 21 |
| 0020=22 | 9C | 49 | 05 | 21 | 80 | A7 | 49 | 34 | 77 | 4B | 3D | 27 | 4D | 8D | B2 |
| 0030=07 | A5 | 0B | AD | 24 | 08 | 8F | 39 | 02 | 3B | 4F | 43 | A2 | 28 | 0D | 0A |
| 0040=40 | 0C | 6C | 2A | 08 | 4B | 2E | 4F | 45 | 0C | 7C | 10 | 41 | 4E | 2C | 39 |
| 0050=13 | 27 | 8E | 43 | BB | BF | 80 | A8 | 21 | 12 | 0C | 0D | BC | 42 | 34 | 90 |
| 0060=A5 | 47 | 20 | E9 | 23 | 87 | 27 | DE | 80 | 9B | 78 | 1A | 24 | A4 | 3F | AE |
| 0070=28 | 15 | 7E | 10 | 04 | AC | 0E | 77 | 30 | 43 | 07 | 2E | 28 | 03 | 7F | 28 |
| 0080=2D | 40 | FF | 21 | 21 | 7F | 38 | 2F | 4E | 2F | 80 | 77 | 0B | 95 | 04 | 46 |
| 0090=13 | 60 | 14 | 27 | 10 | 7B | 35 | 03 | 60 | 1F | 17 | 34 | 11 | 8E | F2 | 60 |
| 00A0=9C | 19 | 47 | 95 | 2C | 83 | 30 | 41 | F2 | F9 | 9B | 4A | 28 | 4E | 04 | 10 |
| 00B0=2C | AA | 78 | 37 | 38 | BC | 2C | BC | 50 | 4F | 18 | 3B | 2E | 47 | 81 | 0B |
| 00C0=2B | 40 | 38 | 21 | 27 | 97 | 0B | 46 | 44 | 8E | 0B | 3D | 3D | 59 | C0 | 27 |
| 00D0=14 | 36 | 9B | FF | 42 | 89 | 98 | 49 | 04 | 9C | 84 | 93 | 46 | 2E | E4 | 0F |
| 00E0=BA | 44 | 0F | FD | 2E | B6 | 0B | E4 | 62 | 15 | 20 | 3A | 04 | 07 | 27 | 3B |
| 00F0=21 | 0B | 3B | 3B | 0B | 0F | DD | 4B | 1D | 2D | 44 | 6C | 48 | DD | 80 | 0B |
| 0100=69 | 6F | 8E | BC | 4F | 4D | 39 | 60 | 66 | 15 | 68 | 65 | 98 | D9 | 3C | 68 |
| 0110=A4 | 7F | 2C | 8D | A1 | 0F | 3F | 21 | 3D | 2D | 60 | 29 | A1 | 47 | A1 | AF |
| 0120=00 | 18 | 2A | 27 | 44 | 68 | 1F | 03 | 14 | 9A | 3D | 4B | A6 | B6 | 7E | 77 |
| 0130=85 | 4B | 4D | 06 | 51 | AA | 24 | 63 | 7E | 41 | 3F | 61 | 21 | AF | 62 | 68 |
| 0140=6E | 3E | 2C | 94 | 27 | 45 | 3A | 27 | FD | 2C | 86 | 21 | 14 | 9A | 38 | 0F |
| 0150=24 | C2 | D0 | 46 | 25 | 16 | 32 | 4D | 34 | 2E | 44 | 41 | 28 | AB | 03 | 38 |
| 0160=8F | F9 | 06 | 84 | 10 | 39 | 21 | 78 | 3E | 4C | 80 | 27 | 43 | A9 | 22 | 40 |
| 0170=10 | 3C | 42 | 8E | 21 | AC | 23 | 28 | OF | A7 | 27 | 21 | 3A | 4E | 2F | 86 |
| 0180=2A | 4F | 13 | 38 | 97 | 98 | 2C | 89 | 80 | 28 | 2C | 1B | 66 | 9F | 21 | 10 |
| 0190=14 | 10 | AD | 48 | 39 | 4A | 4A | 3A | 9B | 66 | BF | 13 | 39 | 2E | 2E | FD |
| 01A0=AF | BD | 0B | 80 | 38 | 0F | 60 | 4A | F0 | 3A | 17 | 82 | 3F | 80 | 84 | B4 |
| 01B0=14 | 79 | 60 | 2C | 17 | 3F | 3A | 3F | BD | 8B | 46 | 4E | 3F | 21 | 46 | 2C |
| 01C0=42 | 28 | 70 | 7F | 6F | AD | 6D | 24 | 9A | 62 | 14 | 70 | 6E | 6B | 40 | 50 |
| 01D0=19 | 6E | 6F | 42 | 2A | 39 | 92 | 84 | 91 | 6F | 66 | 77 | 86 | FD | 3F | 81 |
| 01E0=80 | 8D | B4 | 6F | 77 | 0F | 2C | F5 | 4F | 93 | AB | 7E | 70 | 66 | 70 | 0F |
| 01F0=78 | 9A | 60 | 4A | 60 | 28 | 91 | 21 | 70 | 8E | 4E | 22 | B3 | 29 | 41 | 0F |
| 0200=42 | 39 | 22 | 99 | 60 | 28 | 60 | 2D | 42 | 43 | 91 | 21 | 8E | 72 | 3F | 40 |
| 0210=14 | 1E | 1E | 68 | A6 | 4A | 4E | 2C | B8 | 1E | 6E | 28 | 27 | EB | FF | 22 |
| 0220=AE | 27 | C1 | 99 | FA | 41 | 18 | 4E | 27 | 60 | 3F | 2C | 3F | 6C | 45 | 19 |
| 0230=4D | 75 | D3 | 2F | 2F | 8F | 4A | 2F | 0F | 60 | 15 | 9F | 40 | 19 | B7 | 3A |
| 0240=11 | 38 | 23 | A6 | A6 | 0F | 2F | 2E | A2 | 2B | 86 | 40 | 4F | 21 | 98 | 80 |
| 0250=15 | A6 | 2D | FE | 21 | 2B | 33 | 6C | 31 | 07 | 2F | 2D | EB | 70 | 04 | 2B |
| 0260=80 | 32 | 3B | 6A | 38 | 77 | 2D | 70 | 46 | A6 | 41 | 82 | 82 | 22 | 11 | B9 |
| 0270=82 | 4F | 25 | 96 | 00 | 30 | 4F | 7C | 2D | 73 | A1 | 42 | B7 | 28 | 21 | 40 |
| 0280=27 | 20 | FE | 51 | 0A | 2B | 60 | A1 | 04 | 0F | 44 | 46 | 2E | 34 | 28 | 2C |
| 0290=1E | 88 | 77 | 43 | 0D | 61 | 9E | 07 | 17 | 4F | 11 | 2E | 2C | 48 | 18 | 4E |
| 02A0=81 | 19 | 7F | 45 | 92 | 2C | 68 | 64 | 60 | 23 | 45 | BA | 37 | 27 | 80 | B9 |
| 02B0=B0 | 62 | 33 | 46 | B1 | 5A | 42 | 3B | 44 | 30 | 6F | AC | 8E | 38 | 9E | 3A |
| 02C0=40 | 68 | 27 | 6C | 27 | B9 | 40 | 02 | 06 | 86 | 2F | 00 | 38 | 07 | 40 | 83 |
| 02D0=94 | 40 | FA | 2E | 25 | 48 | 05 | 9C | 27 | 8A | 93 | 27 | 04 | 22 | 77 | 2B |
| 02E0=B2 | 40 | 22 | 66 | 0B | A4 | 4B | 2F | 56 | 0B | 21 | 22 | B1 | 3D | B9 | C1 |
| 02F0=23 | 2B | 14 | F2 | 18 | 8B | 20 | 1A | BA | 10 | 50 | 42 | 9F | C1 | 10 | 0B |
| 0300=7E | 8F | A3 | 42 | 62 | 3B | 46 | BB | 64 | 7D | 42 | 9C | 20 | 1B | DA | 46 |
| 0310=00 | 66 | 2A | A3 | 86 | 60 | 60 | 3D | 3A | 21 | B4 | 3A | F7 | 14 | 33 | BB |
| 0320=00 | 70 | 6B | 2E | 48 | 2C | 72 | 10 | 00 | B4 | 18 | 43 | 9D | 39 | 9C | 43 |
| 0330=92 | AA | B7 | 0F | 37 | 28 | A9 | 28 | 1C | 25 | BC | 23 | 45 | 4F | B5 | 7E |
| 0340=37 | 4A | 17 | 31 | 10 | F0 | B0 | 16 | 17 | F2 | A2 | 45 | 2A | 27 | 78 | B3 |
| 0350=8D | A8 | 28 | 10 | C1 | 4D | C9 | 0C | 62 | 1A | A9 | 2E | 16 | 9C | 21 | 44 |
| 0360=A2 | BA | 0C | F0 | 43 | 77 | C9 | B0 | 73 | 36 | 1A | 16 | 43 | 3A | B0 | 4A |
| 0370=14 | 17 | C1 | 7C | 35 | 82 | 4E | 2C | C9 | 9B | 7C | C0 | 7C | 1E | 87 | 62 |
| 0380=7D | 8A | 21 | 70 | 10 | 3D | 19 | AC | 27 | C9 | 34 | 77 | 22 | FE | 3A | 70 |
| 0390=37 | 10 | 23 | 45 | 8C | 36 | BB | 24 | 87 | 24 | 95 | F0 | 82 | AB | 4A | 9E |
| 03A0=8A | 42 | F2 | 4A | 45 | BB | 28 | 22 | 35 | 42 | 15 | 36 | 11 | 7B | 50 | BA |
| 03B0=28 | 2C | 92 | 40 | 28 | BB | BB | 14 | 0F | 2D | 32 | 0F | 6F | FE | 19 | 4A |
| 03C0=4E | 2A | B2 | 0D | 74 | 55 | 2C | 08 | 77 | 2D | 3E | 8C | 18 | 4B | 2E | 70 |
| 03D0=15 | 84 | 84 | 1D | 72 | 75 | 15 | 40 | 41 | 8E | 2D | 6E | 47 | FF | B7 | 4F |

TABLE A-continued

CHAPTER ϕ
ROM MEMORY MAP
(Program Counter Sequence)

| | | | | | | | | | | | | | | | |
|---|---|---|---|---|---|---|---|---|---|---|---|---|---|---|---|
| 03E0=9B | 3D | 9A | 33 | 30 | 8C | 80 | C0 | 27 | 6C | A8 | 28 | 93 | 9B | 21 | 04 |

TABLE B

CHAPTER 1
ROM MEMORY MAP
(Program Counter Sequence)

| | | | | | | | | | | | | | | | |
|---|---|---|---|---|---|---|---|---|---|---|---|---|---|---|---|
| 0000=2C | 4B | BA | 21 | 99 | 30 | 95 | 06 | 27 | 77 | 91 | BA | 70 | 78 | 39 | BF |
| 0010=16 | 21 | 9A | 3F | BA | 0B | 0B | 7D | 28 | 06 | 03 | 95 | 4C | 85 | 48 | BB |
| 0020=AB | 39 | 70 | 38 | 48 | 56 | 99 | A1 | 35 | 56 | 14 | 2C | 0F | 48 | A8 | 83 |
| 0030=89 | 4A | 25 | 7E | 05 | 49 | 28 | 50 | 62 | 4F | 21 | 25 | 21 | 05 | 30 | 04 |
| 0040=C9 | 37 | 06 | 23 | 90 | 41 | 21 | 41 | 14 | 2D | B7 | 27 | 0F | 24 | EF | 29 |
| 0050=11 | E0 | 9A | 40 | C0 | 35 | 4F | 33 | 49 | 39 | 06 | 59 | 3E | 40 | 40 | 27 |
| 0060=80 | 47 | 38 | 30 | 0F | 11 | 22 | 2F | A5 | 5B | 1B | 2B | 06 | 03 | 35 | 21 |
| 0070=27 | 4B | 95 | C9 | 25 | 21 | 8D | 2B | 27 | 0F | 2F | 20 | 27 | 27 | 40 | 33 |
| 0080=80 | 60 | 30 | 2D | 93 | B7 | 32 | 7B | 00 | B8 | 38 | 7C | B8 | 83 | 41 | BF |
| 0090=83 | 99 | B8 | 3A | B8 | B8 | 41 | 9B | 00 | 78 | A4 | 7D | 9B | 2F | 0F | 72 |
| 00A0=0B | 4E | 38 | 25 | 74 | A8 | 99 | 83 | 23 | A4 | 3A | 21 | 22 | B4 | 00 | 4E |
| 00B0=8B | 46 | 00 | 8E | 00 | 40 | 7D | 2F | 23 | 38 | 27 | BC | 20 | 00 | 40 | 70 |
| 00C0=2E | 49 | 23 | 21 | 80 | 2B | A5 | 2B | 1D | 12 | 2B | 4E | BC | 2B | 4E | 46 |
| 00D0=21 | FB | 89 | 8C | 33 | 4E | 2D | 27 | 82 | 23 | 0F | 4E | 2F | 27 | 05 | 06 |
| 00E0=BE | BE | 59 | 00 | 46 | 7F | 00 | 23 | 20 | A4 | 03 | BE | 38 | 7E | 20 | 22 |
| 00F0=2B | 40 | 8E | A6 | 3D | 00 | 21 | 41 | 21 | 51 | AD | B5 | 04 | 50 | 04 | 27 |
| 0100=23 | 46 | 2B | 2B | 27 | 40 | 2D | 27 | 2D | 0F | CF | 06 | 2E | 38 | 20 | 20 |
| 0110=1D | 22 | 2B | 1B | FF | 93 | 7F | 27 | 2E | 4E | 04 | BC | 21 | B6 | 82 | 21 |
| 0120=8C | 21 | 2B | 9A | 21 | 16 | BB | 81 | 40 | B1 | 13 | B6 | 82 | 21 | 2F | 21 |
| 0130=49 | 00 | 32 | 00 | 50 | 22 | 2F | 2F | 4A | 40 | 46 | 47 | 23 | BA | 00 | 40 |
| 0140=47 | 2F | 2D | 21 | 8C | 45 | C0 | 40 | 41 | 45 | 87 | 3A | 00 | 18 | 38 | 2F |
| 0150=48 | 05 | 47 | 27 | 21 | 49 | 2D | B4 | 22 | 91 | 98 | DD | 14 | 80 | 2F | 06 |
| 0160=AA | 27 | 5B | 38 | 06 | 7F | AE | 32 | 87 | 21 | 2E | 9E | 40 | 1B | 0F | 45 |
| 0170=2F | 11 | 92 | 2D | 2F | 51 | 48 | 9E | E0 | BA | 04 | 38 | 00 | 43 | 2D | 27 |
| 0180=4A | 23 | 60 | 46 | 22 | 91 | 7A | BE | 93 | 0F | 3E | 27 | 27 | 8C | 27 | 48 |
| 0190=15 | 74 | 20 | 7F | 9B | 7A | 8B | 4E | 60 | 23 | 93 | 79 | 46 | 23 | 37 | 23 |
| 01A0=8C | 22 | 4E | 06 | 07 | 20 | A2 | 79 | 0B | 7E | AD | 07 | 77 | 07 | 21 | 03 |
| 01B0=4E | 22 | 7E | 8B | 23 | 20 | 26 | 0F | 03 | 3C | 7E | 27 | 22 | 06 | 29 | 4E |
| 01C0=11 | CC | 4E | 39 | 26 | 31 | 90 | B4 | 4E | 77 | 0F | 29 | 2D | 23 | 4C | F4 |
| 01D0=11 | 33 | 60 | 03 | 0B | 35 | 77 | 6C | 70 | 34 | 23 | CC | 60 | 03 | 2D | 31 |
| 01E0=91 | 03 | 4D | 3D | 35 | 20 | 20 | 2E | AB | 4A | 1F | 98 | B0 | AA | 46 | 22 |
| 01F0=4C | EF | 7E | 33 | 2E | 59 | 31 | AA | 16 | 20 | 22 | 7E | 37 | 21 | 4E | 2B |
| 0200=2D | 40 | 45 | 22 | 18 | 3A | 4E | 39 | 9C | FE | 0F | B6 | 29 | 32 | AB | BB |
| 0210=1E | 23 | 1B | 12 | 18 | 23 | 39 | 49 | 1A | 41 | 31 | 0F | 13 | 1F | F1 | 31 |
| 0220=AA | 2D | 2D | 2C | D9 | 2D | FB | 00 | FE | C0 | 7E | CC | 9C | ED | 36 | 3B |
| 0230=E5 | 37 | 22 | 40 | 16 | A7 | 1B | CC | A4 | FF | 0B | 0F | 13 | 32 | 4A | 2E |
| 0240=40 | 2B | 40 | 21 | 0F | 34 | 21 | 2E | 03 | 40 | 4F | 36 | 40 | 40 | 12 | 48 |
| 0250=8C | 3D | 48 | E4 | 80 | 21 | 2F | 03 | A9 | E4 | 1A | 03 | 36 | 82 | DE | 03 |
| 0260=C7 | 2F | 03 | 4A | 2E | 2C | A1 | 21 | 7C | 21 | 7E | 48 | 3C | C7 | 34 | 1D |
| 0270=21 | 27 | 80 | 48 | 90 | 96 | 3D | 0F | 3C | D2 | 45 | 03 | 5D | 05 | 03 | 04 |
| 0280=2E | 40 | 3A | 6F | 2D | 98 | 0B | 63 | A5 | 30 | 2D | 1B | 2C | BD | 38 | 4C |
| 0290=B1 | 38 | 8C | 1B | A4 | 4A | 38 | BC | 1B | 21 | 7B | 4C | 2D | BA | 19 | 60 |
| 02A0=00 | 48 | A4 | 1C | 19 | A4 | 9E | 4B | 1F | 39 | 33 | 4B | A1 | 4B | 4A | B5 |
| 02B0=80 | 80 | 75 | 2D | 91 | 2D | 21 | 38 | 3A | AB | AB | 4E | 3A | 21 | 40 | 2F |
| 02C0=45 | 22 | 8B | 5E | 1F | 4D | 12 | 90 | 58 | D3 | 60 | 0F | 27 | 70 | 38 | 2F |
| 02D0=17 | 90 | 17 | 12 | 15 | 60 | 7E | 5D | 7C | 2E | 80 | 98 | 3E | 96 | 3B | 40 |
| 02E0=AA | 70 | 45 | 95 | AE | 60 | AA | 77 | 9C | 88 | 0B | 85 | 96 | 0B | 90 | 2E |
| 02F0=96 | 70 | 4A | 3D | 5B | 8B | 1C | 49 | 1A | 8E | 7C | 21 | B3 | 2B | BB | 7B |
| 0300=5D | 91 | 8B | 2F | A6 | BB | 2F | 4E | 8C | 1D | 1E | 40 | 1F | 21 | 7E | 3F |
| 0310=23 | 78 | CF | 90 | 70 | 3D | 20 | 00 | 20 | 93 | 4E | 2C | A4 | 20 | B3 | B8 |
| 0320=80 | 38 | 70 | 20 | 40 | EF | 47 | 98 | 9A | 16 | BF | 98 | BB | 27 | A3 | 56 |
| 0330=0F | 21 | 16 | 38 | 31 | 39 | 40 | 23 | 46 | BB | 7E | 05 | 40 | 22 | 40 | 2D |
| 0340=2C | 4E | 49 | 30 | 98 | 3A | 43 | 2E | ED | ED | 48 | 88 | C0 | 3A | 1A | 4A |
| 0350=0F | 33 | 32 | 31 | 90 | 30 | 8E | 45 | 16 | 41 | 2E | AD | 89 | C0 | C0 | 36 |
| 0360=A1 | 2D | 4C | AD | A1 | 2D | 16 | 35 | 34 | 0F | 02 | 38 | 44 | 36 | 3A | 93 |
| 0370=DF | 3A | 21 | C9 | 46 | E0 | BB | 1F | 4D | 18 | 14 | 4F | C7 | D6 | 12 | 0F |
| 0380=18 | C9 | 43 | 3A | B2 | 9C | 2E | B1 | A3 | 70 | 70 | 5B | BC | 4B | 4D | C6 |
| 0390=41 | C6 | 80 | 1B | 0B | 80 | 1B | AA | 20 | 7B | 91 | 0F | 1F | 9C | 18 | 38 |
| 03A0=21 | 8B | 38 | 91 | 7B | 1B | 70 | CF | 8E | 53 | 18 | 98 | 9E | 3A | 4B | BA |
| 03B0=56 | 39 | 79 | 16 | 20 | 57 | 13 | 5C | 93 | 33 | 20 | 20 | C9 | BA | 3A | 98 |
| 03C0=7D | 8F | 70 | 37 | 33 | B4 | 4D | 32 | 3A | 95 | A4 | 55 | 4D | 1D | B5 | 7F |
| 03D0=13 | A6 | AB | 23 | 21 | 29 | 22 | 90 | 88 | 25 | 22 | 3E | 4E | 17 | 42 | 29 |
| 03E0=B2 | 80 | 4E | 80 | 4A | 70 | 2E | 07 | 4E | AE | 41 | 41 | 78 | 15 | 2C | 2E |
| 03F0=74 | 18 | 0F | 4D | 55 | 1D | A2 | 61 | 33 | 86 | 90 | 2B | 39 | 27 | 25 | 46 |

What is claimed is:

1. An electronic strategy game comprising:

a console adapted to be passed between players of the game, a Keyboard on the console having a plurality of keys each for representing a different command, a display on the console including a plurality of indicators representing a galaxy and arranged in a matrix, one of said indicators representing the players starship and at least one other of said indicators at least at some time representing a planet, and another indicator representing an enemy starship, less than all of said indicators being illuminated for each player, said display being a priviledged information display wherein the location of a player's starship is hidden from the other players, said console having means for selectively initiating each turn, said display also including means for displaying a remaining energy readout, each said player having a different display arrangement corresponding to its own starship location, and control means having communication lines intercoupling with the display and keyboard and including means for receiving command signals from the keyboard for controlling the starship position by movements in any one of a number of different directions with each move expending at least one energy unit, and means for receiving command signals to fire the starships weapons along different courses, each hit on an enemy starship costing the enemy player at least one energy unit and each firing costing the player at least one energy unit, said control means also including means for controlling the display indicators to simultaneously represent said player's starship and planet in a visually distinguishable manner, and means for controlling the display indicators to simultaneously represent the planet and enemy starship in a visually indistinguishable manner.

2. An electronic game as set forth in claim 1 including means for causing flashing of an indicator wherein the indicator representative of the player's starship is at least at certain times represented by a flashing indicator with the other indicators being illuminated in a steady fashion representing enemy starships and planets.

3. An electronic game as set forth in claim 2 wherein the illuminated planets remain fixed during a game.

4. An electronic game as set forth in claim 2 wherein said control means includes means for limiting a move only to an adjacent cell on the display while firing occurs across the display unless blocked by a planet indicator.

5. An electronic game as set forth in claim 1 including selection buttons on the keyboard for selecting at least two different levels of play each having a corresponding different initial energy level.

6. An electronic game as set forth in claim 1 including means responsive to a player moving into the same location within a sector occupied by another player to randomly relocate that player to a different location on the display.

7. An electronic game as set forth in claim 1 including means responsive to a hit player to relocate that player to a random location on the display.

8. An electronic game as set forth in claim 1 including means responsive to only a single player having unused energy units to signal a winner of the game.

9. An electronic game as set forth in claim 1 including means responsive to a starship moving to a predetermined position to increase the energy supply of that starship.

10. An electronic game as set forth in claim 1 wherein the matrix display is a square matrix with n rows driven by n/2 signals from the computer.

11. An electronic game as set forth in claim 1 including means responsive to a player moving onto a predetermined sector to randomly relocate that player to a different sector.

12. An electronic game as set forth in claim 1 including means responsive to a key operation for making that player's starship invisible on the other players display at a cost of at least one energy unit to that player.

13. An electronic game as set forth in claim 1 including means for accommodating one to four players.

14. An electronic game as set forth in claim 13 wherein said controlled means includes means for maintaining track of the sequence of the players to display the players' identification in sequence.

15. An electronic game as set forth in claim 14 wherein means for maintaining track of the player sequence has the ability of dropping players whose energy has been expended from the sequence.

16. An electronic game as set forth in claim 1 wherein two different scales of display readout are provided.

17. An electronic game as set forth in claim 1 wherein said console includes means for initiating each turn, said display being non-information bearing prior to such initiation.

18. An electronic game as set forth in claim 17 wherein said means for initiating includes a start-of-turn button and further including an end-on-turn button useable by the present player to blank the display after the turn so that no information of starship location is conveyed to the next player.

19. An electronic game as set forth in claim 1 including means for providing combat and non-combat modes of operation.

20. An electronic game as set forth in claim 1 including means permitting occupation of a planet by a starship.

21. An electronic game as set forth in claim 1 including means for providing a teach mode.

22. An electronic game as set forth in claim 1 including means on the keyboard for selecting at least two different levels of play in which each higher level adds more options while maintaining all options of the lower level.

23. An electronic strategy game and corresponding method of play comprising the steps of; providing a console adapted to be passed between players of the game, providing a keyboard on the console having a plurality of keys, each for representing a different command including move and fire commands, displaying at some place on the console with a plurality of indicators representing a galaxy and arranged in a matrix, the indicators being displayed representing the player's starship, at least one enemy starship, and at least one other indicator representing a planet, or less than all of said indicators being illuminated for each player, said display being a privileged information display wherein information blanking occurs at the end of each turn so that the location of a player's starship is hidden from the other players, displaying a remaining energy readout, with a corresponding readout being provided in turn for each of the players in the game, simultaneously illuminating said enemy starship and planet indicators indistinguishably, simultaneously illuminating said starship and planet indicators visually distinguishably, and controlling the display via the keyboard by receiving command signals from the keyboard for controlling the starship position by movements in any one of a number of different directions with each move expending at least one energy unit, firing the starship weapons along different courses with each hit of an enemy starship costing the enemy player at least one energy unit and each firing expending at least one energy unit of the present player.

* * * * *